US005584431A

United States Patent [19]

Clement

[11] Patent Number: 5,584,431

[45] Date of Patent: Dec. 17, 1996

[54] DEVICE FOR DISPENSING CANS FROM CARTON

[76] Inventor: Philip Clement, 5819 Wendorf La., Jefferson, Wis. 53549

[21] Appl. No.: 541,940

[22] Filed: Oct. 10, 1995

Related U.S. Application Data

[63] Continuation of Ser. No. 175,293, Dec. 29, 1993, abandoned.

[51] Int. Cl.[6] ..... B65D 5/42

[52] U.S. Cl. ..... 229/125; 211/71; 248/146

[58] Field of Search ..... 229/125; 211/71–73; 248/146, 150, 152, 188.1, 188.2, 312, 312.1, 688

[56] References Cited

U.S. PATENT DOCUMENTS

| | | | |
|---|---|---|---|
| 1,241,633 | 10/1917 | Johnson . | |
| 2,144,534 | 1/1939 | Hedquist et al. | 211/71 |
| 2,322,748 | 6/1943 | Shaw et al. | 211/71 |
| 2,491,652 | 12/1949 | Feerick | 211/71 |
| 2,635,762 | 4/1953 | Shaw | 211/71 |
| 2,763,423 | 9/1956 | Bloomer, Sr. | 229/7 |
| 2,867,019 | 1/1959 | Streeter et al. | 24/81 |
| 2,894,308 | 7/1959 | Eckstein | 24/259 |
| 2,950,514 | 8/1960 | Small | 24/81 |
| 3,349,446 | 10/1967 | Haygeman | 229/125 |
| 3,591,120 | 7/1971 | Fietzer | 211/71 |
| 3,952,876 | 4/1976 | Price | 248/146 |
| 4,087,068 | 5/1978 | Gardner | 248/688 |
| 4,408,689 | 10/1983 | Daniels | 229/125 |
| 4,624,380 | 11/1986 | Wernette | 220/6 |
| 5,033,669 | 7/1991 | Federico | 229/199 |
| 5,141,117 | 8/1992 | Olsen et al. | 211/71 |
| 5,303,889 | 4/1994 | Malik et al. | 248/250 |
| 5,314,152 | 5/1994 | Troy et al. | 248/146 |

*Primary Examiner*—Gary E. Elkins
*Attorney, Agent, or Firm*—Michael, Best & Friedrich

[57] ABSTRACT

A device for dispensing containers, such as cans of beer or soda, from a carton including a plurality of overlapping flaps which form an end wall of the carton and which can be separated and folded outwardly to open the carton. The dispensing device comprises a frame defining an opening for receiving the carton and having an inner periphery which at least partially surrounds the outer periphery of the carton and is dimensioned to slide over and engage the flaps when in the folded back position and retain them in that position. Preferably, the device also includes a base connected to the frame for resting on a support surface and supporting the frame and the open end of the carton at an elevation above the opposite end thereof so as to prevent the containers from rolling out of the open end of the carton.

10 Claims, 1 Drawing Sheet

DEVICE FOR DISPENSING CANS FROM CARTON

This is a continuation of application Ser. No. 08/175,293, filed Dec. 29, 1993, entitled "Device for Dispensing Cans from Carton", now abandoned.

BACKGROUND OF THE INVENTION

1. Field of the Invention

The invention relates to devices for retaining containers in an open condition, and more particularly to a dispensing device for retaining the flaps forming an openable end wall of a carton in an open condition.

2. Reference to Prior Art

Paperboard cartons are widely used for holding multiple cans of beverages such as soda or beer. A carton for holding twelve cans of beverage is commonly known as a "twelve pack". Cartons such as the twelve pack carton are typically constructed by forming a single sheet or piece of paperboard or other material into the desired shape of the carton. The top, bottom and side walls of such cartons are typically formed by folding the piece of paperboard along edges corresponding to edges of each wall. Each end wall is typically formed by four flaps which are releasably fastened in overlapping relationship with each other. To open the carton, the overlapping flaps are separated from each other and folded outwardly. After the flaps are folded outwardly, they are free to move or flap about. Frequently, the flaps will return toward the closed position instead of remaining folded outwardly. This causes great inconvenience, in that a person must either fold the flaps outwardly each time a can is obtained or else ignore the flaps and maneuver his hand through the flaps, grab a can, and maneuver his hand and the can back out of the carton between the flaps. In addition to this inconvenience, the flaps frequently prevent beverage retailers, caterers, concessionaires and others from displaying and selling individual cans from twelve pack containers, because the flaps prevent purchasers from obtaining an unobstructed view of the cans in the open carton. Twelve pack cartons also are not widely used in such sales settings because, unless the carton is set upright to rest on the closed end opposite the open end, cans will frequently roll or fall out of the open carton. Because of poor product visibility and vertical space constraints, setting the carton upright to rest on the closed end is disfavored in many circumstances.

Also, some consumers like to leave cans of soda or beer in the carton for refrigeration or cooling, because the cans are kept separate from other articles in the refrigerator or cooler. When the flaps on one end of the carton are opened for removal of individual cans, the same inconveniences exist.

U.S. Pat. No. 2,763,423 to Bloomer, Sr. discloses a flap retaining device for retaining in a folded back position the flaps of a carton containing bulk goods which are to be scooped out of the carton. The device includes a rigid, inwardly extending flange fitting over the top or folding edge of the carton and against which a scoop may be scraped to remove excess material therefrom.

SUMMARY OF THE INVENTION

The invention provides a dispensing device for retaining the flaps of an open end of a carton in a folded back position to display containers in the carton and/or permit convenient access to such containers.

A dispensing device of the invention also supports the carton on a surface such that the carton is inclined upwardly from the closed end toward the open end to prevent containers from falling or rolling out of the carton.

A dispensing device of the invention also prevents movement of the ends of the carton relative to each other and thereby simplifies removal of containers from the carton and prevents collapse or deformation of the carton.

The dispensing device also provides an outwardly facing surface for displaying advertising indicia such as the brand of beverage contained in the carton.

Other objects, aspects and advantages will become evident to those skilled in the art upon reviewing the following detailed description, drawings and claims.

More particularly, the invention provides a device for dispensing containers from a carton which includes opposed longitudinal walls cooperating to define an outer periphery, and opposed end walls formed by overlapping flaps. Each flap has a folding edge connected to a respective longitudinal wall and a terminal edge opposite the folding edge. The overlapping flaps can be separated and folded outwardly to a folded back position to open the carton. The dispensing device includes a frame which defines an opening for receiving the carton. The frame has an inner periphery which at least partially surrounds the outer periphery of the longitudinal walls and is dimensioned to slide over the carton to a location between the folding and terminal edges of the flaps and engage and retain the flaps in the folded back position.

The invention also provides a device for supporting a carton on a support surface and dispensing cans from the carton. In addition to the frame described above, the dispensing device includes a base connected to the frame for resting on the support surface and supporting the frame with the open end of the carton at an elevation above the opposite end of the carton, so that the carton is inclined upwardly in a direction from the closed end toward the open end. Preferably, the frame includes a bottom frame member adjacent and extending along the width of the bottom wall of the carton, and the base is connected to the bottom frame member and includes a front portion which extends downwardly from the bottom frame member and rests on the support surface. More preferably, the front portion of the base member includes a surface facing outwardly relative to the open end of the carton, and advertising indicia is displayed on the surface.

The invention also provides a dispensing device adapted for holding a carton on its side which includes, in addition to the frame and base described above, a base rear portion for receiving the rear portion of the carton and preventing movement of the rear portion of the carton relative to the front portion of the carton. Preferably, the base rear portion includes a pair of upwardly extending arms adjacent a pair of the opposed longitudinal walls of the carton for receiving the rear portion of the carton.

Figure 2:
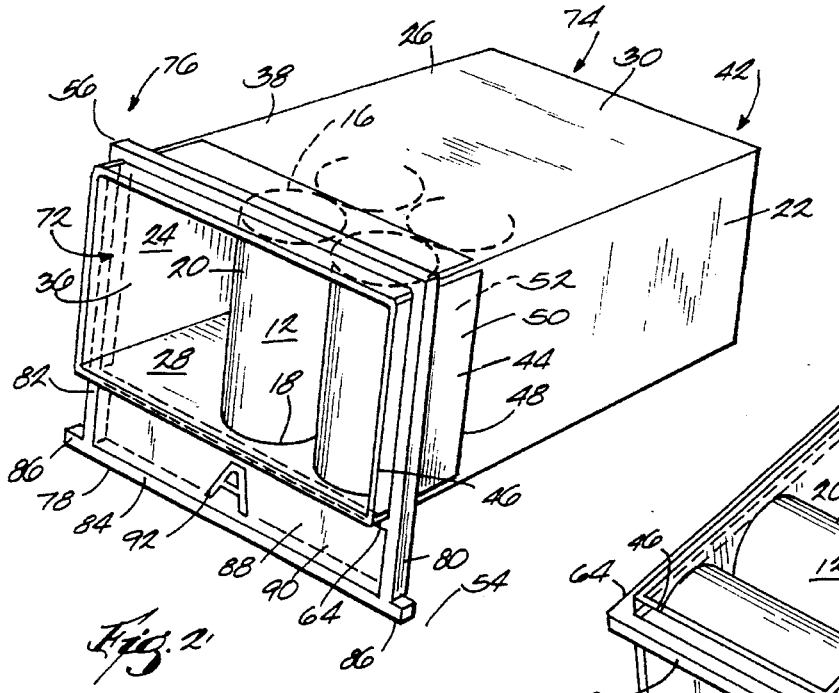
FIG. 2 is a perspective view of another embodiment of the invention adapted to support the carton on a surface with the containers or cans in a normal upright position.

Before one embodiment of the invention is explained in detail, it should be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF A PREFERRED EMBODIMENT

Figure 1:
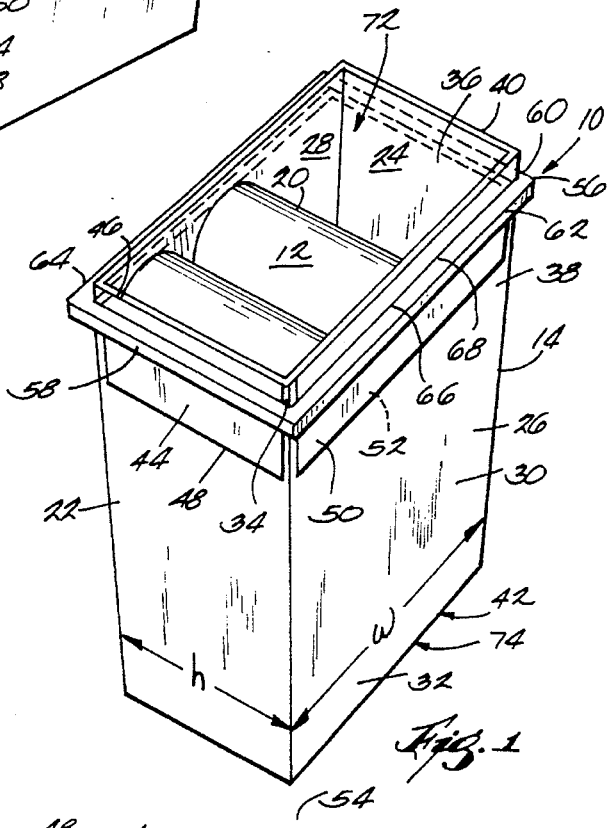
FIG. 1 is a perspective view of a carton with a dispensing device in accordance with one embodiment of the invention on the carton for retaining the flaps in the folded back position.

Illustrated in FIG. 1 is a device 10 for dispensing containers or cans 12 from a carton 14. Although the dispensing device 10 can be employed for dispensing various objects from a range of suitably adapted cartons, the device is particularly adapted for dispensing beverage cans from a "twelve-pack" carton, and will be described in connection with that application.

The cans 12 each include opposed top and bottom walls 16 and 18 and a cylindrical sidewall 20. The containers 12 can also be conventional bottles or other suitable containers. Typically, an individual serving of a liquid beverage such as soda or beer is contained in each can 12. The cans 12 are openable in a conventional manner for drinking the beverage.

The carton 14, which is of conventional design, includes longitudinally extending, opposed side walls 22 and 24 and opposed top and bottom walls 26 and 28. For purposes of description, the side walls 22 and 24 and top and bottom walls 26 and 28 are collectively referred to as the longitudinal walls 30. Each of the longitudinal walls 30 includes opposed end portions 32 and 34 and opposed interior and exterior surfaces 36 and 38. The carton 14 has a height (h), which is the distance between the exterior surfaces 38 of the top and bottom walls 26 and 26, and a width (w) which is the distance between the exterior surfaces 38 of the side walls 22 and 24. The longitudinal walls 30 cooperate to define an outer periphery 40.

The carton 14 also includes opposed end walls 42. Each end wall 42 is formed by four overlapping flaps 44. Each flap 44 includes a folding edge 46 connecting the flap 44 to a respective longitudinal wall 30. Each flap 44 also includes a terminal edge 48 opposite the folding edge 46. Each flap 44 also includes opposed interior and exterior surfaces 50 and 52. Each flap 44 is foldable about the folding edge 46 between a closing position wherein the flap 44 is folded inwardly at a ninety degree angle from the respective longitudinal wall 30 and a folded back position wherein the flap 44 is folded outwardly such that the exterior surface 52 of the flap 44 is adjacent the exterior surface 38 of the respective longitudinal wall 30. Each end wall 42 is formed by the flaps 44 being folded to the closing position such that the flaps 44 are in overlapping relationship with each other and are releasably fastened in such overlapping relationship by suitable releasable fastening means (not shown). To open an end wall 42, the fastened, overlapping portions of the flaps 44 are separated, and the flaps 44 are folded outwardly to the folded back positions.

The embodiment of the dispensing device 10 illustrated in FIG. 1 is particularly useful in situations where one end wall 42 of the carton 14 rests on a support surface 54, such as inside a portable cooler or the like, and the opposite end wall 42 is opened for access to the cans 12. The dispensing device 10 includes a frame 56 having opposed side frame members 58 and 60 and opposed top and bottom frame members 62 and 64 corresponding to the respective side walls 22 and 24 and top and bottom walls 26 and 28 of the carton 14. Preferably, the frame 56 is molded from a synthetic thermosetting or thermoplastic material to facilitate mass production and minimize material costs. Each of the side and top and bottom frame members 58, 60, 62 and 64 has an inner edge portion 66 for engaging the respective longitudinal wall 30 of the carton 14. The inner edge portions 66 of the side and top and bottom frame members 58, 60, 62 and 64 cooperate to define an opening having an inner periphery 68 approximately equal to, but slightly greater than, the outer periphery 40 of the carton 14 with the flaps 44 in the folded back position.

In use, one end wall 42 is opened by separating and folding outwardly the overlapping flaps 44 to thereby define an open end 72 of the carton 14 and a closed end 74 opposite the open end 72. The closed end 74 is placed on the support surface 54. With the flaps 44 in the folded back position, the frame 56 is slipped over the open end 72 of the carton 14 and along the longitudinal walls 30 and folded back flaps 44 to a location between the folding and terminal edges 46 and 48 of the flaps 44. In this location, the frame member inner edge portions 66 engage the flaps 44 and retain the flaps 44 in the folded back position, thereby providing unobstructed access to the cans 12 in the carton 14.

In the embodiment illustrated in FIG. 2, the dispensing device 76 is arranged to support a carton 14 with the bottom wall 28 resting on a support surface 54 such as a refrigerator shelf, with the cans 12 in a normal upright position. Components common with those for the embodiment illustrated in FIG. 1 are identified with common reference numerals. The device 76 includes a frame 56 as described above and a base 78 connected to the frame 56 for supporting the carton 14 with the bottom wall 28 resting on a support surface 54. The base 78 includes a pair of spaced, vertically extending legs 80 and 82 connected to the bottom frame member 64. Each of the legs 80 and 82 is an extension of the frame side members 58 and 60. An elongated front support member 84 extends between the legs 80 and 82. The front support member 84 is parallel to and spaced downwardly from the bottom frame member 64. A pair of feet 86 project laterally outwardly from the front support member 84 beyond the legs 80 and 82, respectively. The feet 86 act as stabilizers to prevent the carton 14 from tipping over during use. A web section 88 including an outwardly facing surface 90 extends between the bottom frame member 64, legs 80 and 82, and front support member 84. Advertising indicia 92 is displayed on the surface 90.

In use, one end wall 42 of the carton 14 is opened as described above. The flaps 44 on the open end 72 are folded to a folded back position, and the frame 56 is slipped over the open end 72 and the folded back flaps 44 to a location between the folding and terminal edges 46 and 48 to retain the flaps 44 in the folded back position. The base 78 rests on the support surface 54 and supports the frame 56 with the open end 72 above the surface 54. A portion of the bottom wall 28 of the carton 14 adjacent the closed end 74 rests on the support surface 54, so that the carton 14 is inclined upwardly in a direction from the closed end 74 toward the open end 72. In this manner, the cans 12 are prevented from falling or rolling out of the open end 72 and are also fully visible and readily assessable when the carton 14 and dispensing device 76 are placed on a refrigerator shelf or the like.

Figure 3:
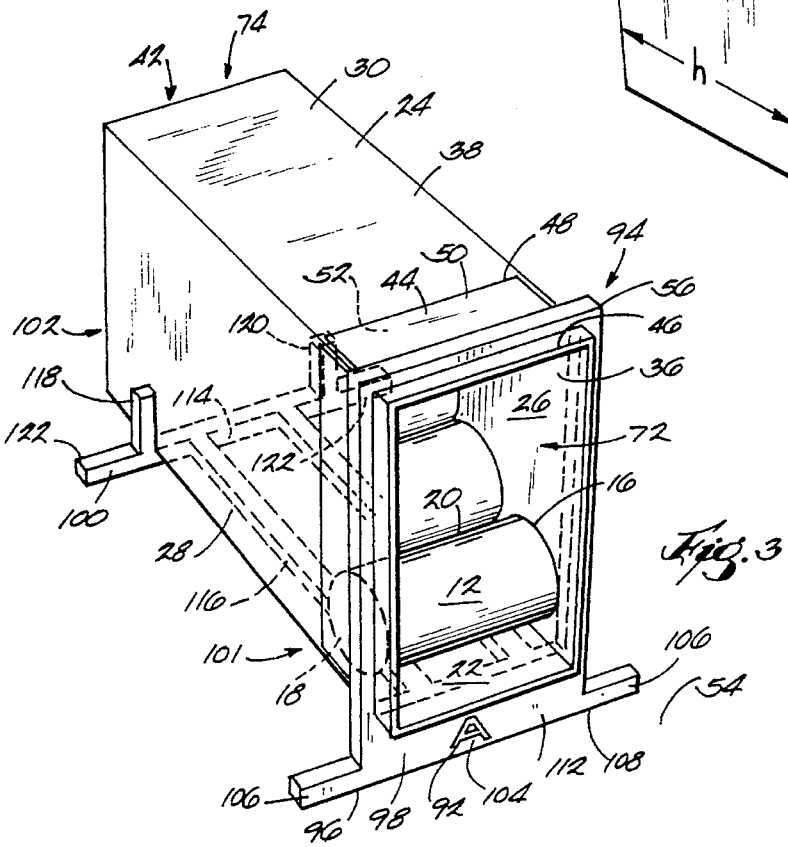
FIG. 3 is an elevated perspective view of another embodiment of the invention adapted to support the carton on a surface with the containers or cans on their sides.

In the embodiment illustrated in FIG. 3, the dispensing device 94 is arranged to hold a carton 14 with a side wall 22 oriented toward a support surface 54, such as a refrigerator shelf, with the cans 12 on their sides. Components common with those for the embodiment illustrated in FIG. 1 are identified with common reference numerals. The device 94 includes a frame 56 and a base 96 having a front portion 98 connected to the frame 56 for receiving the front portion 101 of the carton 14 and a rear portion 100 for receiving the rear portion 102 of the carton 14. The front portion 98 of the base 96 includes a front support member 104 extending downwardly from the bottom frame member 64. A pair of feet 106 extends laterally outwardly from the front support member 104 beyond the frame 56 and the sidewalls 26 and 28 of the carton 14. The front support member 104 includes an elongated bottom edge portion 108. The bottom edge portion 108 and feet 106 rest on the support surface 54 and support the frame 56 with the front portion 101 of the carton 14 above the support surface 54. The feet 106 act as stabilizers for preventing the carton 14 from tipping over during use. The front support member 104 also includes an outwardly facing surface 112 on which advertising indicia 92 is displayed.

The rear portion 100 of the base 96 includes an elongated rear support member 114 which extends laterally and generally parallel to the front support member 104 and is connected to the front portion 98 by one or more generally horizontally extending connecting members 116 (two shown). The rear portion 100 rests on the support surface 54. The rear portion 102 of the carton sidewall 22 rests on the rear support member 114 and is supported thereon above the support surface 54. Extending upwardly from the rear support member 114 are a pair of arms 118 and 120 which are spaced apart at a distance approximating, but slightly larger than, the height (h) of the sidewalls 22 and 24 of the carton 14. The rear portion 102 of the carton 14 is received between the arms 118 and 120, which prevent significant movement of the rear portion 102 of the carton 14 relative to the front portion 110. Similar to the feet 106 on the front portion 98, a pair of rear feet 122 extend laterally outwardly from the rear support member 114 beyond the arms 118 and 120, respectively, and thus beyond the top and bottom walls 26 and 28 of the carton 14, to act as further stabilizers for preventing the carton from tipping over during use.

The front portion 98 of the base 96 and the frame 56 support the front portion 101 of the carton 14 above the rear portion 102, so that the carton 14 is inclined upwardly from the rear portion 102 toward the front portion 101. Thus, the cans 12 are readily assessable and clearly visible and will not fall or roll out of the open end 72 of the carton 14. Additionally, the base rear portion 100 prevents the rear portion 102 of the carton 14 from shifting or twisting as cans 12 are removed therefrom.

In use, one end wall 42 of the carton 14 is opened and the flaps 44 are folded back as described above. The carton 14 is turned on one sidewall 22 and placed between the arms 118 and 120 with the open end 72 behind the frame 56. With the flaps 44 folded back, the open end 72 is slipped through the frame 56 to a location between the folding and terminal edges 46 and 48 of the flaps 44. The dispensing device 94 and the carton 14 can then be placed on the shelf of a refrigerator or the like and are ready for dispensing individual cans 12.

I claim:

1. A device for dispensing containers from a carton having a generally rectangular cross section and including a plurality of opposed longitudinal walls and opposed end walls each having an exterior, the longitudinal walls cooperating to define an outer periphery, and at least one of the end walls being formed by four overlapping flaps which have a folding edge connected to a respective longitudinal wall and a terminal edge, which can be separated and folded outwardly to open the carton and which can be folded to a folded back position adjacent the exterior of the respective longitudinal wall, said device comprising a one-piece frame including opposed side frame members and opposed top and bottom frame members cooperating to define a generally rectangular opening for receiving one end of the carton formed by the four overlapping flaps and having an inner periphery which at least partially surrounds the outer periphery of the longitudinal walls of the carton and is dimensioned to permit all of said frame members to slide completely over and past respective folded edges of all four flaps and engage all four flaps when all are in the folded back position and retain them in that position when the frame is at a location between the folding and terminal edges of the flaps.

2. The device according to claim 1 wherein said frame is constructed from a synthetic thermoplastic or thermosetting material.

3. A device for supporting a carton on a support surface and dispensing cans from the carton, the carton having a generally rectangular cross section and including a plurality of opposed longitudinal walls and opposed end walls each having an exterior, the longitudinal walls cooperating to define an outer periphery, and at least one of the end walls being formed by four overlapping flaps which have a folding edge connected to a respective longitudinal wall and a terminal edge, which can be separated and folded outwardly to open the carton to thereby define an open end of the carton and which can be folded to a folded back position adjacent the exterior of the respective longitudinal wall, said device comprising a one-piece frame including opposed side frame members and opposed top and bottom frame members cooperating to define a generally rectangular opening for receiving the open end of the carton and having an inner periphery which surrounds the outer periphery of the longitudinal walls and is dimensioned to permit all of said frame members to slide completely over and past respective folding edges of all four flaps and engage all four flaps when in the folded back position and retain them in that position when the frame is at a-location between the folding and terminal edges of the flaps; and a base connected to and extending from one of said frame members for resting on the support surface and supporting said frame and the open end of the carton at an elevation above the opposite end of the carton when resting on the support surface.

4. The device according to claim 3 wherein the carton has a front portion including the open end and a rear portion including the opposite end; and said base includes a front portion connected to said frame and a rear portion for receiving the rear portion of the carton and preventing lateral movement thereof relative to the front portion of the carton after installation of the carton in said device.

5. The device according to claim 4 wherein said base rear portion includes a pair of upwardly extending arms for receiving the rear portion of the carton and preventing lateral movement thereof relative to said front portion after installation of the carton in said device.

6. The device according to claim 3 wherein said frame and said base are constructed from a synthetic thermoplastic or thermosetting material.

7. A device for supporting a carton on a support surface and dispensing cans from the carton, the carton including opposed, longitudinally extending top and bottom walls, opposed, longitudinally extending side walls and opposed end walls, each having an interior, the longitudinal walls cooperating to define an outer periphery and at least one of the end walls being formed by a plurality of overlapping flaps which have a folding edge connected to a respective longitudinal wall and a terminal edge, which can be separated and folded outwardly to open the carton to thereby define an open end of the carton and which can be folded to a folded back position adjacent to the exterior of the respective longitudinal wall, said device comprising a frame defining an opening for receiving one end of the carton formed by the overlapping flaps and having an interior periphery which surrounds the outer periphery of the longitudinal walls of the carton and is dimensioned to slide completely over and past the folded edges of the carton and engage all the flaps when all are folded in the folded back position and retain them in that position when the frame is at a location between the folding and terminal edges of the flaps, said frame including a bottom frame member extending along the length of the bottom wall of the carton; and a base connected to and extending from said bottom frame member for resting on the support surface and supporting said frame and the open end of the carton at an elevation against the opposite end of the carton when resting on the support surface.

8. The device according to claim 7 wherein the front portion of said base includes an outwardly facing surface having advertising indicia thereon.

9. The device according to claim 7 wherein the carton has a front portion including the open end and a rear portion including the opposite end; and said base includes a front portion connected to said frame and a rear portion for receiving the rear portion of the carton and preventing lateral movement thereof relative to said front portion after installation of the carton in said device.

10. The device according to claim 9 wherein said base rear portion includes a pair of upwardly extending arms for receiving the rear portion of the carton and preventing movement thereof relative to said front portion.

* * * * *